US008727518B2

(12) United States Patent
Gordon

(10) Patent No.: US 8,727,518 B2
(45) Date of Patent: May 20, 2014

(54) METHOD FOR POSITIONING A METERING BLADE WITH REFERENCE TO ROLLER AND BLADE WEAR

(75) Inventor: Michael C. Gordon, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 5 days.

(21) Appl. No.: 13/493,715

(22) Filed: Jun. 11, 2012

(65) Prior Publication Data

US 2013/0328966 A1 Dec. 12, 2013

(51) Int. Cl.
*B41J 2/165* (2006.01)

(52) U.S. Cl.
USPC ..... 347/88

(58) Field of Classification Search
None
See application file for complete search history.

(56) References Cited

U.S. PATENT DOCUMENTS

| | | | | |
|---|---|---|---|---|
| 5,937,257 | A | 8/1999 | Condello et al. | |
| 7,113,735 | B2 | 9/2006 | Schlien et al. | |
| 7,362,994 | B2 | 4/2008 | Zess et al. | |
| 7,376,378 | B2 | 5/2008 | Van Bortel | |
| 7,458,671 | B2 | 12/2008 | Leighton et al. | |
| 7,540,600 | B2 | 6/2009 | Fioravanti et al. | |
| 7,677,717 | B2 | 3/2010 | Islam et al. | |
| 7,783,210 | B2 | 8/2010 | Thayer et al. | |
| 7,938,528 | B2 | 5/2011 | Thayer et al. | |
| 8,007,099 | B2 | 8/2011 | Domoto et al. | |
| 8,042,930 | B2 | 10/2011 | Burress et al. | |
| 8,066,366 | B2 | 11/2011 | Fioravanti et al. | |
| 8,177,352 | B2 | 5/2012 | Fioravanti et al. | |
| 2007/0139496 | A1* | 6/2007 | Leighton et al. | 347/88 |
| 2009/0304402 | A1* | 12/2009 | Thayer et al. | 399/44 |
| 2010/0053261 | A1 | 3/2010 | Thayer et al. | |
| 2010/0231674 | A1 | 9/2010 | Domoto et al. | |
| 2011/0032287 | A1 | 2/2011 | Fioravanti et al. | |
| 2011/0032288 | A1 | 2/2011 | Fioravanti et al. | |
| 2011/0032306 | A1 | 2/2011 | Fioravanti et al. | |
| 2011/0149002 | A1 | 6/2011 | Kessler | |
| 2011/0221841 | A1 | 9/2011 | Kwong et al. | |
| 2011/0292142 | A1 | 12/2011 | LeFevre et al. | |

* cited by examiner

*Primary Examiner* — Alejandro Valencia
(74) *Attorney, Agent, or Firm* — Maginot, Moore & Beck, LLP

(57) ABSTRACT

A method has been developed to enable a controller to select between two angles at which to position a wiper configured to wipe release agent from an image drum. The controller selects the position of the wiper with reference to the number of times the wiper has wiped the image drum and the number of media sheets that have contacted the image drum.

8 Claims, 4 Drawing Sheets

METHOD FOR POSITIONING A METERING BLADE WITH REFERENCE TO ROLLER AND BLADE WEAR

TECHNICAL FIELD

This disclosure relates generally to imaging devices and, in particular, to maintenance systems for such imaging devices.

BACKGROUND

Solid inkjet imaging systems generally use an electronic form of an image to generate firing signals that operate inkjets within printheads to eject ink melted from a solid ink stick or pellet onto an image receiving surface to reproduce the electronic image. In some solid inkjet imaging systems, the ink is ejected directly onto a media sheet, while in other solid inkjet imaging systems, the ink is ejected onto the surface of an intermediate imaging member and the ink image is transferred to a media sheet passed through a nip formed between the intermediate imaging member and a transfer roller. The heat and pressure in the nip help transfer the ink image from the intermediate imaging member to the media sheet, which is transported from the system and deposited in a paper tray.

In solid ink imaging systems having intermediate imaging members, ink is loaded into the system in a solid form, either as pellets or as ink sticks, and transported through a feed chute by a feed mechanism for delivery to a melting device. The melting device heats the solid ink to a temperature at which the solid ink melts and the melted ink is delivered to a printhead for jetting onto an intermediate imaging member. In the printhead, the liquid ink is typically maintained at a temperature that enables the ink to be ejected by the printing elements in the printhead, but that preserves sufficient tackiness for the ink to adhere to the intermediate imaging member. In some cases, however, the tackiness of the liquid ink may cause a portion of the ink to remain on the intermediate imaging member after the image is transferred onto the media sheet and the residual ink may degrade subsequent ink images formed on the intermediate imaging member.

To address the accumulation of ink on an intermediate imaging member, which may be in the form of a drum, solid ink imaging systems may be provided with a drum maintenance unit (DMU). In solid ink imaging systems, the DMU is configured to 1) lubricate the image receiving surface of the intermediate imaging member with a very thin, uniform layer of release agent before each print cycle, and 2) remove and store any excess release agent, ink and debris from the surface of the intermediate imaging member after each print cycle. During each print cycle, the release agent deposited on the intermediate imaging member may be controlled with a metering blade. The metering blade is designed to distribute release agent and remove excess release agent from the intermediate imaging member so the release agent does not adulterate the media sheet in the nip.

Release agent is removed from the DMU each time a page is printed. A DMU includes a limited amount of release agent, and the DMU must be replaced when the release agent is depleted. Therefore, applying only the amount of release agent necessary for efficient and effective transfer of an ink image to a printed media sheet without adversely affecting image quality on the sheet is desirable. If the release agent transferred to a media sheet falls below a predetermined threshold, however, print defects and media transport issues may occur. Applying the minimal effective amount of release agent is also affected by metering blade wear. Because metering blades wear with use over time, an excessive amount of release agent or an uneven layer of release agent may be applied to the intermediate imaging drum. An incorrect or inconsistent amount of release agent applied to the surface of the intermediate imaging drum may result in some of the solid ink adhering to the imaging drum or excess release agent being transferred to the media, which also causes print defects. Thus, improved and consistent metering of release agent in a solid ink printer is desirable.

SUMMARY

A method of adjusting release agent thickness on an image drum with reference to a roller count and a wiper count has been developed. The method comprises: generating a wiper count corresponding to a number of times a wiper has wiped release agent onto a surface of an image drum configured to receive melted solid ink ejected from a plurality of inkjet ejectors in at least one printhead; generating a roller count corresponding to a number of media sheets that have contacted the surface of the image drum, the roller count being generated independently of the wiper count generation; applying release agent to the surface of the image drum; selecting, with reference to the wiper count and the roller count, one of a second position and a third position for the wiper, the wiper in the second position being in contact with the surface of the image drum at a first angle to enable the wiper to leave a first thickness of release agent on the surface of the image drum and the wiper in the third position being in contact with the image drum at a second angle to enable the wiper to leave a second thickness of release agent on the surface of the image drum; and actuating a cam to move the wiper from a first position, in which the wiper is not in contact with the image drum, to the selected one of the first position and the second position to apply release agent to the surface of the image drum.

In another embodiment, a metering blade assembly has been developed. The assembly comprises: a wiper; a cam operatively connected to an actuator and the wiper to move the wiper in response to the actuator moving between a first position in which the wiper does not contact the surface of an image drum having release agent and configured to receive a plurality of melted solid ink drops ejected from at least one printhead, a second position in which the wiper contacts the surface of the image drum at a first angle to enable the wiper to leave a first thickness of release agent on the image drum, and a third position in which the wiper contacts the surface of the image drum at a second angle to enable the wiper to leave a second thickness of release agent on the image drum; and a controller configured to generate a wiper count corresponding to a number of times the wiper has wiped the image drum, to generate independently of the wiper count a roller count corresponding to a number of media sheets that have contacted the image drum, and to actuate the cam to move the wiper from the first position selectively to one of the second and third positions with reference to the wiper count and the roller count.

In yet another embodiment, a drum maintenance unit for a printer has been developed. The drum maintenance unit comprises: an applicator configured to apply release agent to an image drum in the printer; a wiper positioned between the applicator and a printhead to enable the wiper to engage selectively the image drum after the applicator applies release agent to the image drum and before the printhead ejects ink onto the image drum; a wiper mount operatively connected to the wiper; a cam operatively connected to an actuator, the cam being configured with a first dwell surface, a second dwell surface, and a third dwell surface, each dwell surface is configured to engage the wiper mount selectively to move the wiper to a first position in which the wiper does not contact the image drum in response to the first dwell surface engaging the wiper mount, to a second position in which the wiper contacts the image drum at a first angle to enable the wiper to leave a first thickness of release agent on the image drum in response to the second dwell surface engaging the wiper mount, and to a third position in which the wiper contacts the surface of the image drum at a second angle to enable the wiper to leave a second thickness of release agent on the image drum in response to the third dwell surface engaging the wiper mount.

DETAILED DESCRIPTION

Figure 1:
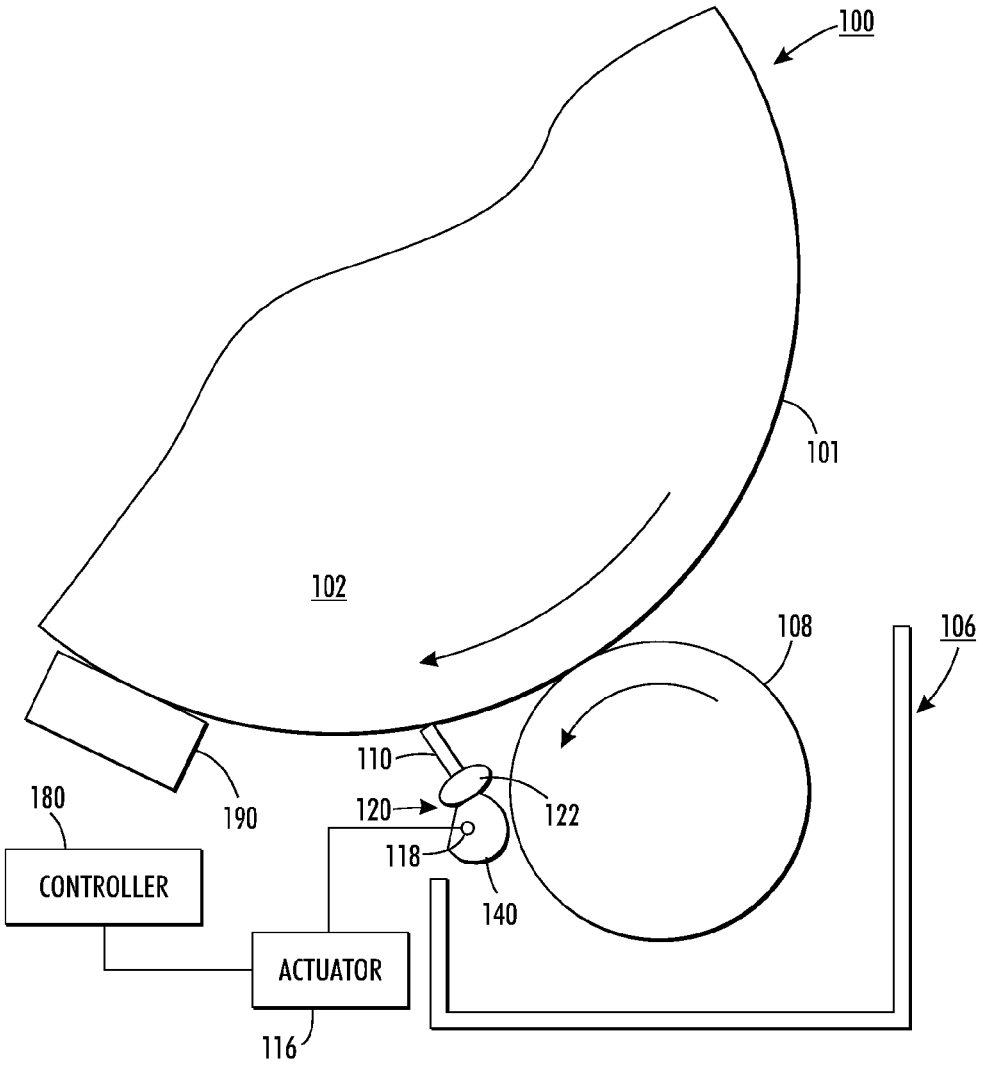
FIG. 1 is a schematic diagram of a metering blade assembly and roller.

For a general understanding of the present embodiments, reference is made to the drawings. In the drawings, like reference numerals have been used throughout to designate like elements. As used herein, the terms "printer," "printing device" or "imaging device" generally refer to a device that produces an image with one or more colorants on print media and may encompass any such apparatus, such as a digital copier, bookmaking machine, facsimile machine, multi-function machine, etc. which generates printed images for any purpose. "Print media" can be a sheet of paper, plastic, or other suitable physical print media substrate for images. A "print job" or "document" is normally a set of related sheets, usually one or more collated copy sets copied from a set of original print job sheets or electronic document page images, from a particular user or otherwise related. An image generally may include information in electronic form which is to be rendered on the print media by the image forming device and may include text, graphics, pictures, and the like. The operation of producing images with colorants on print media, for example, graphics, text, photographs, etc., is generally referred to herein as printing or marking.

Figure 6:
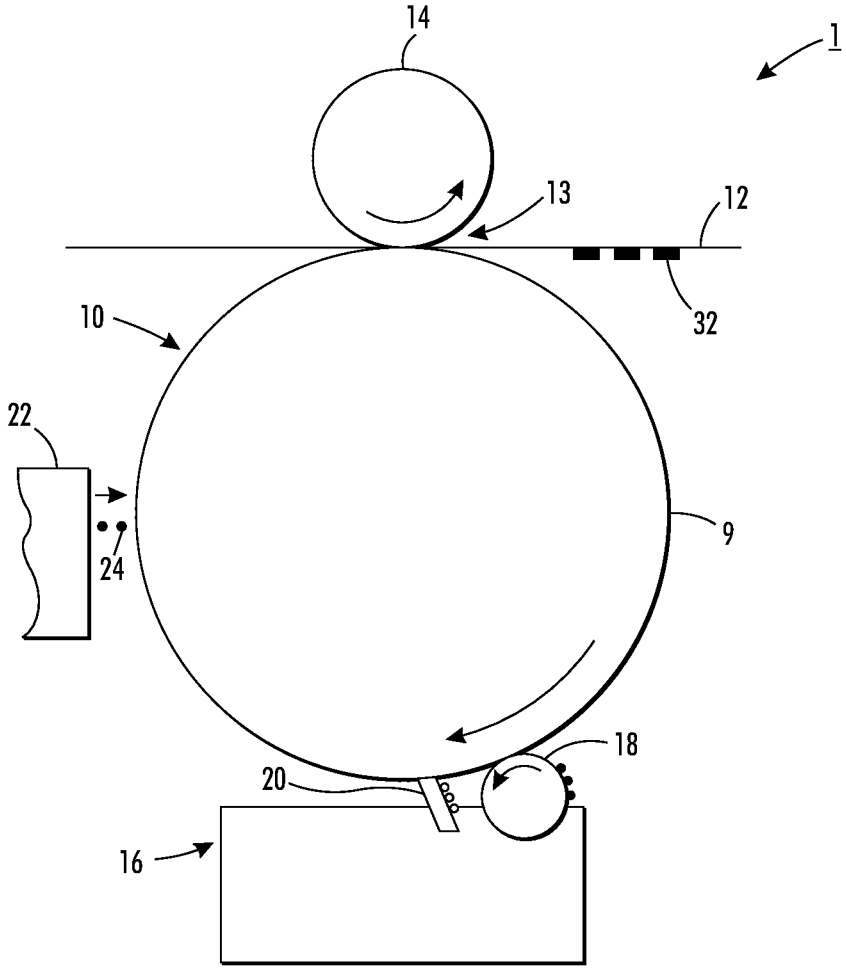
FIG. 6 PRIOR ART
FIG. 6 is a schematic diagram of a prior art imaging drum.

Referring now to FIG. 6, an embodiment of a prior art printing device 1 is illustrated to show a printing device configuration that enables an ink image 24 to be formed with melted solid ink on a layer of release agent on a rotating imaging member (shown as a drum 10 in FIG. 6) and then transferred to a print medium or other image receiving substrate 12. During formation of an ink image, the transfix roller 14 is positioned so the roller 14 does not contact the surface 9 of the drum 10. As the drum 10 turns in the direction indicated by the arrow in the drum, release agent is deposited onto a surface 9 of the drum 10 by a drum maintenance unit (DMU) 16. The release agent is applied to the surface 9 of the drum 10 to facilitate the transfer of the ink image 24 to the print medium 12. The print medium 12 may be any known print media, such as paper, transparent film, or the like. The DMU 16 has an applicator 18 that is configured to contact the surface 9 and apply release agent to the surface 9 of the drum 10. In this prior art device, the applicator 18 is shown as a roller, however, as discussed below in more detail, the applicator 18 may be in a number of different forms. The DMU 16 also has a metering blade 20 that is configured to move into and out of contact with the surface 9, but the wiping angle between the metering blade and the surface 9 remains fixed. The metering blade 20 is brought into contact with the release agent to distribute the release agent applied to the surface 9 and form a thin film of release agent on the drum 10.

After the drum 10 is coated with the release agent, an inkjet device 22 ejects ink towards the surface of the drum 10 to form an ink image 24 on top of the release agent layer. One or more revolutions of the imaging member or drum 10 may be required to form ink image 24. After the ink image is completed, the transfix roller 14 is moved to engage the surface 9 of the drum 10 as the ink image approaches the nip 13 formed by the transfix roller 14 and the drum 10. The print media 12 approaches the nip 13 in synchronization with the ink image 24 so the print media 12 and the ink image 24 pass through the nip 13 at the same time. In this manner, the ink image 24 is transferred from the surface 9 of the drum 10 to the print media 12 to form a final image 32.

Referring now to FIG. 1, an improved inkjet printing device 100 is shown. In device 100, a DMU 106 includes a metering blade assembly 120 and a release agent applicator 108. As illustrated, the applicator 108 is in the form of a roller, which is formed from an absorbent material, such as extruded polyurethane foam. The roller absorbs the release agent received from a source (not shown) located in the DMU 106 and applies it to a surface 101 of a rotating roller (shown in FIG. 1 as an imaging drum 102 of an indirect printer). In alternative embodiments, the applicator 108 can be any device that can apply a release agent to the rotating roller 102. For example, the applicator 108 can be in the form of a sled, a blotter, or a blade. Additionally, the source of the release agent can be any source that can provide the release agent to the applicator 108 as required for application to the roller. For example, the release agent source can be a remote reservoir tank, an adjacent reservoir, or an internal source within the applicator 108. Furthermore, the release agent can be delivered to the applicator 108 by, for example, direct contact, a pump, a wick, a drip bar, or a capillary.

As the roller rotates, the applicator 108 applies release agent to surface 101 of the rotating roller 102. The metering blade assembly 120 is configured to wipe the surface 101 containing release agent to spread out the release agent and reduce the thickness of the release agent film on the surface 101. As the roller 102 continues to rotate, a printhead 190 ejects drops of melted solid ink on top of the release agent on the roller 102. The roller 102 transfers the melted solid ink and release agent to a media sheet (not shown) in a nip formed with a transfix roller (not shown).

The metering blade assembly 120 includes a metering blade 110, a wiper mount 122, and a cam 140. The wiper mount is operatively connected to the metering blade 110 and configured to support and move the metering blade into and out of engagement with the surface 101 of the rotating roller 102. The cam 140 includes three dwell surfaces 144, 148, and 152 (FIG. 2-FIG. 4) configured to engage a surface 124 (FIG. 2-FIG. 4) on the wiper mount 122 to position the wiper mount 122 and wiper blade 110. The cam 140 is operatively connected to an output shaft 118 of an actuator to enable the cam to rotate in response to the actuator output shaft 118 rotating. The position of the metering blade 110 with respect to the roller 102 is thus adjusted by operation of the actuator 116 moving the cam 140, which moves the wiper mount 122.

As discussed generally above, once the release agent is applied to surface 101 of the rotating roller 102 by the applicator 108, the metering blade 110 removes excess release agent and distributes release agent uniformly across the surface 101 to form a film of release agent on the rotating roller 102. The thickness of the release agent film is dependent upon the angle of the metering blade 110 with respect to the surface 101 of the rotating roller 102. An optimum wiping angle that minimizes the thickness of the release agent film left on the surface of the rotating roller 102 in one embodiment is approximately 64 degrees, although the optimum wiping angle can vary depending on the wiper blade material and the drum surface properties. Increasing the wiping angle results in additional release agent left on the roller, but may result in chattering of the blade on the roller, which leaves a non-uniform layer of release agent on the roller and can result in image defects. Decreasing the wiping angle below the optimum wiping angle results in an increased thickness of release agent on the roller while enabling the thickness to be uniform. Accordingly, the amount of release agent left on the drum by the wiper can be increased from the minimum amount by decreasing the wiping angle from the optimum wiping angle.

Controlling the thickness of the release agent film on the surface 101 by adjusting the angle of the metering blade 110 preserves the quality of the images on the media. In previously known solid ink printers, issues may arise as the metering blades and roller surfaces wear and the consistency of the release agent layer on the roller begins to vary. Specifically, as a printing device 100 is used, the metering blade 110 wears from, for example, contact with the surface 101 of the roller 102, while the surface 101 wears from, for example, contact with the metering blade, media sheets, and release agent applicator. Adjusting the angle of the metering blade 110 with respect to the roller surface alters the amount of release agent removed from the surface 101 by the metering blade 110 and enables the amount of release agent on the roller to be adequate for printing processes.

In the embodiment shown in FIG. 1, the angle of the metering blade 110 relative to the surface 101 is accomplished by the controller 180 operating the actuator 116 to move the cam 140, which has surfaces configured to engage the wiper mount 122 to move the blade 110. In other embodiments, the wiper mount 122 and cam 140 can be any device capable of adjusting the angle and pressure of the metering blade 110 relative to the surface 101 of the roller 102. Other mechanisms can be used provided the combination of components in the mechanism are arranged to vary the angle of the blade with reference to the surface of the roller 102.

The controller 180 is configured with programmed instructions and electronic interface components to enable the controller to operate the actuator and position the metering blade 110. The controller 180 is also configured to generate a signal that operates the actuator 116 to produce mechanical movement and position the metering blade at a selected angle. For example, in one embodiment, the controller 180 generates an electrical signal that enables a current to pass through a coil of a solenoid to close a pair of contacts that enable electrical power to be supplied to the actuator. The actuator in this embodiment is an electrical motor, such as a stepper motor, that produces rotational movement on the output shaft 118 that is mechanically connected to the cam 140, which moves the wiper mount 122. The controller 180 outputs the signal to the solenoid for a predetermined period of time that corresponds to a predetermined amount of rotational movement on the output shaft. The movement of the output shaft 118 of the actuator 116 rotates the cam 140 to enable the wiper mount 122 to engage a dwell surface on the cam 140, which determines the position of the wiper mount 122 and metering blade 110.

Figure 2:
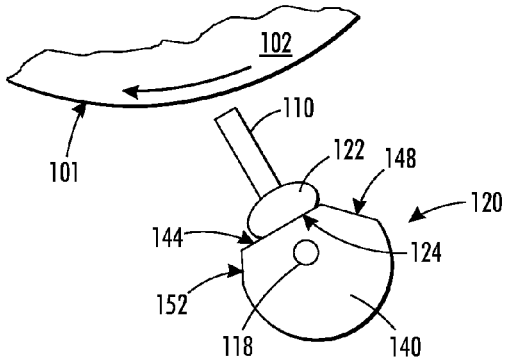
FIG. 2 is a side view of the metering blade assembly of FIG. 1 in a first position.
Figure 3:
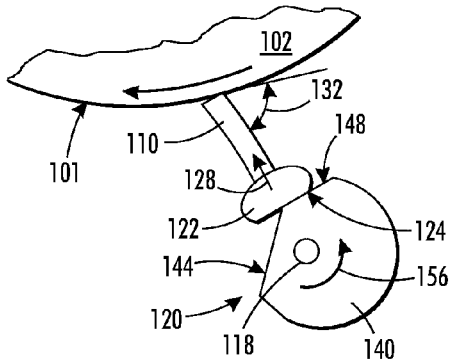
FIG. 3 is a side view of the metering blade assembly of FIG. 1 in a second position.
Figure 4:
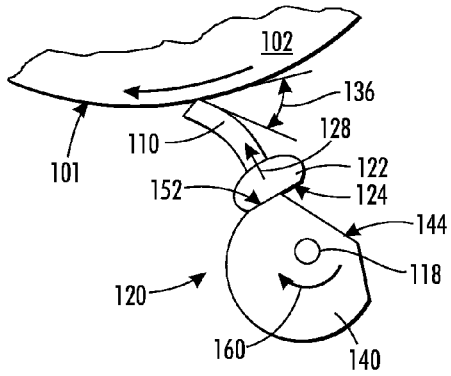
FIG. 4 is a side view of the metering blade assembly of FIG. 1 in a third position.

FIG. 2-FIG. 4 illustrate the metering blade assembly 120 at three different positions with reference to the surface 101 of the roller 102. FIG. 2 depicts the metering blade assembly 120 at a first position, in which the metering blade 110 is not in contact with the surface 101 of the roller 102. The metering blade assembly 120 is configured to rest in the position of FIG. 2 while the ink image is being applied to the roller surface 101, and when the printer is idle or in between media sheets, to prevent excess wear to the roller 102 and metering blade 110. The wiper mount 122 is biased toward the cam 140 by, for example, a spring, to enable the surface 124 of the wiper mount 122 to engage the cam 140. In the position of FIG. 2, the surface 124 on the wiper mount 122 engages a first dwell surface 144 on the cam 140 to position the metering blade 110 a predetermined distance from the surface 101 of the roller 102 where the metering blade 110 does not interfere with the rotating roller 102.

FIG. 3 illustrates the metering blade assembly 120 at a second position, in which the metering blade 110 is in contact with the surface 101 of the roller 102 at a first angle 132. To move from the first position to the second position, the controller 180 activates the actuator 116 to rotate the output shaft 118 in the counter-clockwise direction 156. The cam 140 pushes the wiper mount 122 and metering blade 110 in the direction 128 toward the roller 102 until the surface 124 of the wiper mount 122 engages second dwell surface 148 on the cam 140, and the metering blade 110 is in contact with the surface 101 of the roller 102 at the first angle 132. In the second position, the metering blade 110 is positioned at the angle 132 configured to wipe the maximum amount of release agent from the roller 102 and leave the release agent film at a minimum thickness. In one embodiment the first angle 132 is approximately sixty-four degrees, although the first angle can vary depending on the characteristics of the roller, metering blade, and release agent.

FIG. 4 illustrates the metering blade assembly 120 at a third position, in which the metering blade 110 is in contact with the surface 101 of the roller 102 at a second angle 136. To move from the first position to the third position, the controller 180 activates the actuator 116 to rotate the output shaft 118 in the clockwise direction 160. The cam 140 pushes the wiper mount 122 and metering blade 110 in the direction 128 toward the roller 102 until the surface 124 on the wiper mount 122 engages a third dwell surface 152 on the cam 140. At the third position, the metering blade 110 is in contact with the surface 101 of the roller 102 at the second angle 136, which, in the illustrated embodiment, is less than the first angle 136, to enable the metering blade 110 in the second position to leave a thickness of release agent on the surface 101 that is greater than the thickness of release agent left on the surface 101 when the metering blade assembly 120 is in the first position.

In operation, the printer in which the metering blade assembly 120 and DMU 106 are installed receives electronic image data corresponding to an image to be formed on a media sheet with colorants. The controller 180 generates a signal to operate the actuator 116 to rotate the output shaft 118 to move the metering blade assembly 120 from the first position into contact with the imaging surface 102 at either the second position or the third position. The release agent applicator 108 applies release agent to the surface of the roller 102, which is metered by the metering blade 110 to a thin film spread across the surface 101 of the roller 102. Printhead 190 ejects ink onto the release agent on the surface 101, and the ink is then transferred to a media sheet in a transfix operation as known in the art.

The controller 180 determines whether to position the metering blade assembly 120 in the second or third position with reference to a wiper counter and a roller counter. The wiper counter corresponds to the number of times that the metering blade has wiped release agent from a roller. The roller counter corresponds to the number of media sheets that have contacted the surface of the roller. Although the wiper and roller counters are initially the same value, the controller is configured to reset the wiper counter or the roller counter to zero after replacement of the metering blade or roller, respectively, and begin incrementing the reset counter from zero. Evaluating the wiper counter and roller counter enables the controller to determine whether the upcoming media sheet is at risk for release agent thickness below a predetermined threshold, which can result in image defects or media transport issues. A metering blade that has wiped release agent many times wears, and a worn metering blade is known to leave a greater thickness of release agent on the roller than a new metering blade. Furthermore, the surface of a roller that has printed many media sheets is known to retain a thickness of release agent that is less than the thickness that a new surface retains.

The controller 180 thus evaluates the wear on the metering blade and imaging drum with reference to the wiper count and the roller count to determine whether metering the release agent in the second position could result in release agent on the roller being below the predetermined threshold. If the release agent could be below the threshold, the controller 180 generates signals to operate the actuator to position the metering blade assembly 120 at the third position to enable the metering blade to leave a greater thickness of release agent on the drum, ensuring that the release agent thickness is sufficient. If the controller 180 determines that the release agent left on the roller from the metering blade 110 in the second position is sufficient, the controller 180 generates signals to operate the actuator to move the metering blade assembly 120 to the second position.

In another embodiment the controller is configured to determine whether the wiper in the second position could produce a thickness of release agent on the roller below the threshold. This determination is made by the controller with reference to the wiper counter, the roller counter, and a parameter corresponding to the initial smoothness of the surface of the roller. A roller that has a high level of smoothness results in a lesser thickness of the release agent layer after the roller has been wiped than the thickness of the release agent layer on a roller with a lower level of smoothness. Thus, a roller with a high level of smoothness paired with a newer metering blade is more likely to leave a layer of release agent on the roller having a thickness that is below the predetermined threshold. The controller is configured to account for the high level of smoothness of the roller in determining whether the metering blade is positioned in the second position or the third position. The controller initially positions the metering blade assembly at the third position in a printer having a new metering blade and a smooth roller. After the metering blade and roller have worn sufficiently such that the release agent thickness on the roller does not drop below the predetermined threshold, the controller begins to position the metering blade assembly at the second position. Positioning the metering blade at the lower angle enables the controller to ensure that sufficient release agent remains on the smooth roller when the blade is new. Transitioning back to the second position enables the smooth roller to transfer less release agent to the media sheets, reducing the amount of release agent consumed by each media sheet.

The controller can be further configured to account for properties of the ink image to be ejected onto the roller in determining whether the release agent thickness may be below a thickness that could cause image defects. For example, the controller can be configured to receive data corresponding to a number of ink pixels to be ejected onto the image drum, a resolution for the image data, and identification of colors for the ink pixels to be ejected onto the image drum. Greater ink area coverage, which corresponds to a greater number of ink pixels, a higher resolution, and/or additional pixel colors to be ejected onto the image drum, increases the amount of release agent that is carried by the ink image after it is transferred to the media. Consequently, the image drum has less release agent remaining on it before the next release agent application occurs. Therefore, the controller can be configured to increase the threshold for an image with greater ink area coverage, while decreasing the threshold for an image with lower ink area coverage to compensate for the amount of release agent that is carried out of the printer by the media. Based on these image data combined with the wiper counter, the roller counter, and the drum smoothness parameter, the controller determines with more accuracy whether the release agent thickness obtained by positioning the wiper at the second position is sufficient to avoid image defects for each printed media sheet.

The controller that operates the actuator can be the controller configured to operate the print engine, or a separate controller intended solely to operate the actuator can be used. The controller can be implemented with general or specialized programmable processors that execute programmed instructions. The instructions and data required to perform the programmed functions are stored in memory associated with the processors or controllers. The processors, their memories, and interface circuitry configure the controllers to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 5:
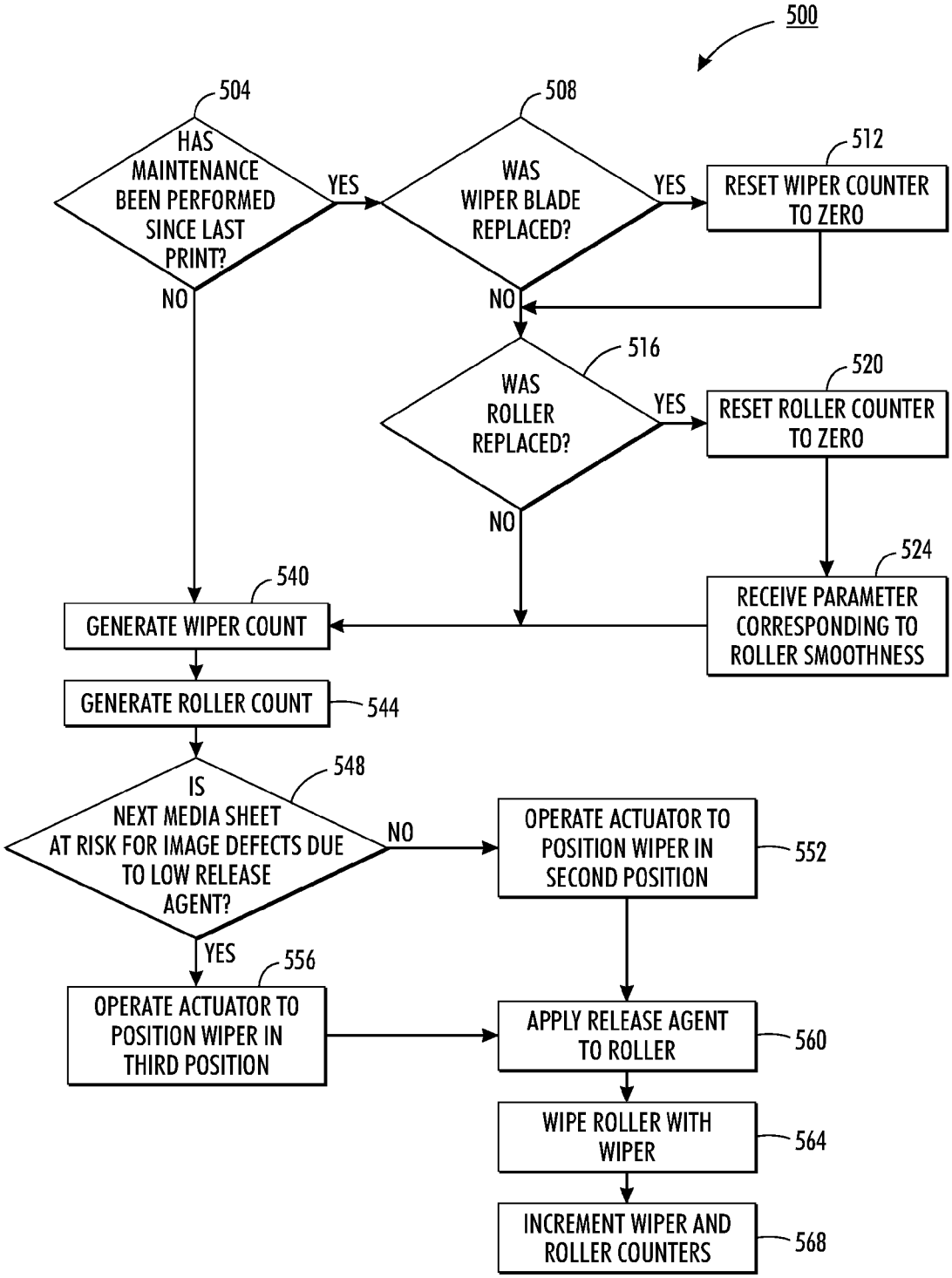
FIG. 5 is a block diagram of a process for operating a metering blade assembly.

FIG. 5 depicts a process 500 for operating a metering blade assembly. Description of the process 500 performing or doing some function refers to a controller, such as the controller 180 described above, executing programmed instructions stored in a memory operatively connected to the controller to cause the controller to operate one or more components of the printer to perform the specified function or action described in the process. The process 500 begins with the controller determining if a maintenance operation has been performed since the last print job (block 504). If a maintenance operation has been performed, the controller determines if the wiper blade was replaced (block 508). The controller can receive information relating to replacement of the wiper blade from the user or the person performing maintenance on the printer. If the wiper blade was replaced, the controller resets the wiper counter to zero (block 512), beginning a new wiper count. The controller next determines whether the roller was replaced in the maintenance operation (block 516). If the roller has been replaced, the controller resets the roller counter to zero (block 520) and begins a new roller count. The controller can also receive a parameter corresponding to a smoothness value of the new roller (block 524). The smoothness parameter can be a value input by the user or person performing the maintenance operation, or the parameter can be a value corresponding to a product number stored in a memory associated with the controller.

The controller is configured to generate a wiper count (block 540) and a roller count (block 544). The wiper count corresponds to a number of times that the wiper has wiped a roller associated with the printer. The counter begins at zero for a new wiper and increments for every page printed. The roller count corresponds to a number of times that the roller has been contacted by a media sheet. The roller count also begins at zero for a new roller, and increments every time a page is printed. Although the wiper and roller counters can be the same when the wiper and roller are the same age, the two counters are updated independently of one another at all other times.

The controller then determines if the next media sheet is at risk for image defects due to low release agent layer thickness (block 548). The controller evaluates the wiper count and the roller count to determine whether the conditions of the roller and wiper can cause the thickness of the release agent layer to be below a threshold at which problems could occur. If available, the controller can factor the roller smoothness into the determination of whether the thickness could fall below the predetermined threshold. If the controller determines that the next media sheet is not at risk for image defects due to low release agent thickness, the controller generates electrical signals to operate the actuator to move the wiper from the first position to the second position (block 552), as described above with reference to FIG. 2-FIG. 4, where the metering blade assembly is configured to leave the minimum release agent on the roller. If the controller determines that the next media sheet is at risk for image defects due to low release agent thickness, the controller generates signals to operate the actuator to move the wiper from the first position to the third position (block 556), as described above with reference to FIG. 2-FIG. 4, to leave a greater thickness of release agent on the roller. The controller applies release agent to the roller (block 560), which is wiped by the wiper as the roller rotates (block 564). The controller then increments the wiper and roller counters (block 568).

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

The invention claimed is:

1. A metering blade assembly for a printer comprising:

a wiper;

a cam operatively connected to an actuator and the wiper to move the wiper in response to the actuator moving between a first position in which the wiper does not contact the surface of an image drum having release agent on the surface of the image drum while a plurality of melted solid ink drops are ejected from at least one printhead onto the release agent on the surface of the image drum, a second position in which the wiper contacts the surface of the image drum at a first angle to enable the wiper to leave a first thickness of release agent on the image drum, and a third position in which the wiper contacts the surface of the image drum at a second angle to enable the wiper to leave a second thickness of release agent on the image drum; and a controller configured to generate a wiper count corresponding to a number of times the wiper has wiped the image drum, to generate independently of the wiper count a roller count corresponding to a number of media sheets that have contacted the image drum, and to actuate the cam to move the wiper from the first position selectively to one of the second and third positions with reference to the wiper count and the roller count and to actuate the cam to return the wiper to the first position while the plurality of solid ink drops are ejected onto the surface of the image drum.

2. The metering blade assembly of claim 1 further comprising:

a memory in which an initial value of a surface roughness of the image drum is stored; and the controller is further configured to modify the surface roughness value with reference to the roller count and to actuate the cam to move the wiper from the first position selectively to one of the second and third positions with reference to the wiper count, the roller count, and the surface roughness value.

3. The metering blade assembly of claim 1, the cam and wiper being further configured to enable the second thickness to be greater than the first thickness.

4. The metering blade assembly of claim 3 further comprising:

a wiper mount fixedly connected to the wiper; and the cam further comprising:

a first dwell surface configured to engage the wiper mount to position the wiper in the first position;

a second dwell surface configured to engage the wiper mount to position the wiper in the second position; and a third dwell surface configured to engage the wiper mount to position the wiper in the third position.

5. The metering blade assembly of claim 1 wherein the image drum is a roller configured to contact a pressure roller to apply pressure to a media sheet containing a plurality of ink pixels.

6. The metering blade assembly of claim 1, the controller being further configured to receive image data used to operate the at least one printhead and to select one of the second and third positions in which to position the wiper with reference to the wiper count, the roller count, and the received image data.

7. The metering blade assembly of claim 6, the image data further comprising:

at least one of a number of ink pixels to be ejected onto the image drum, a resolution for the image data, and identification of colors for the ink pixels to be ejected onto the image drum.

8. The metering blade assembly of claim 1 wherein the first angle is approximately sixty-four degrees.

* * * * *